US005431759A

United States Patent [19]

Neuroth

[11] Patent Number: 5,431,759

[45] Date of Patent: Jul. 11, 1995

[54] CABLE JACKETING METHOD

[75] Inventor: David H. Neuroth, Tulsa, Okla.

[73] Assignee: Baker Hughes Inc., Houston, Tex.

[21] Appl. No.: 199,904

[22] Filed: Feb. 22, 1994

[51] Int. Cl.[6] ..... H01B 13/08; H01B 13/14; H01B 13/26

[52] U.S. Cl. ..... 156/53; 156/54; 156/169; 156/307.1; 156/307.7; 174/102 R; 174/109; 264/174; 264/176.1; 264/177.17

[58] Field of Search ..... 174/102 R, 109, 13, 174/107; 156/48, 51, 52, 53, 54, 169, 307.1, 307.7, 309.9; 264/174, 176.1, 177.17

[56] References Cited

U.S. PATENT DOCUMENTS

| | | | |
|---|---|---|---|
| 3,030,257 | 4/1962 | Whearley et al. | 156/52 |
| 3,041,673 | 6/1962 | Goodwine | 264/313 |
| 3,413,408 | 11/1968 | Robinson | 174/121 R |
| 3,742,363 | 6/1973 | Carle | 174/102 R |
| 3,846,528 | 11/1974 | Chrisman et al. | 264/174 X |
| 3,889,049 | 6/1975 | Legg et al. | 174/102 R |
| 3,890,179 | 6/1975 | Deardurff | 174/124 G X |
| 4,088,830 | 5/1978 | Wargin et al. | 174/113 R |
| 4,096,351 | 6/1978 | Wargin et al. | 174/102 R |
| 4,234,624 | 11/1980 | Linderoth et al. | 427/55 |
| 4,247,271 | 1/1981 | Yonekura et al. | 425/68 |
| 4,247,280 | 1/1981 | Sarracino | 425/445 |
| 4,407,854 | 10/1983 | Pan | 174/25 PX |
| 4,415,518 | 11/1983 | Pochurek et al. | 264/166 |
| 4,435,613 | 3/1984 | Gaubert | 174/102 SC |
| 4,469,539 | 9/1984 | Wade et al. | 156/51 |
| 4,611,656 | 9/1986 | Kendall, Jr. et al. | 174/102 SP X |
| 4,658,089 | 4/1987 | Guzy et al. | 174/113 R |
| 4,675,474 | 6/1987 | Neuroth | 174/102 R |
| 4,681,169 | 7/1987 | Brookbank, III | 174/103 X |
| 4,789,708 | 12/1988 | Guzy | 525/263 |
| 4,820,764 | 4/1989 | Guzy et al. | 524/512 |

*Primary Examiner*—Michael W. Ball
*Assistant Examiner*—Francis J. Lorin
*Attorney, Agent, or Firm*—James E. Bradley; Mark W. Handley

[57] ABSTRACT

An electrical cable and a method for manufacturing the electrical cable are provided in which a plurality of insulated conductors have a protective jacket extruded thereabout, the protective jacket having an exterior ribbed surface which includes a plurality of longitudinally extending ribs between which extend a plurality of thermal expansion voids. The protective jacket is formed from a thermally set elastomeric material which is partially cured, and then a protective exterior armor is helically wrapped around the exteriorly ribbed surface of the elastomeric, protective jacket. Then, the electric cable is heated to an elevated temperature for a period of time which is sufficient for fully curing the elastomeric protective jacket formed therein.

10 Claims, 2 Drawing Sheets

CABLE JACKETING METHOD

BACKGROUND OF THE INVENTION

1. Field of the Invention

This invention relates in general to electrical cables for use in hostile environments, and in particular to an electrical cable for use in an oil and gas well to conduct electrical power to a downhole submersible pump.

2. Description of the Prior Art

This invention concerns electrical cables of the type which are used to power downhole electric motors for submersible pumps within oil and gas wells. These submersible pumps normally pump a mixture of oil and brine from wells often several thousand meters (feet) deep and often under high temperatures and pressures. The electrical cables normally consist of three stranded or solid conductors. Each stranded or solid conductor contains an insulating layer of a material that is resistant to oil and brine. Typically, in a round configuration, an elastomeric, protective jacket is extruded to cover all three conductors, and an outer metallic armor surrounds the jacket.

The elastomeric, protective jacket is typically formed from a thermally set elastomeric material and is used to provide a seal to prevent wellbore fluids from reaching a thermoplastic insulation which forms a sleeve about each of the electrical conductors within the electric cable. Prior art thermally set elastomeric protective jackets are cured either before or after adding the exterior armor by heating the jacket to an elevated temperature for a period of time sufficient to vulcanize the thermally set elastomeric material from which the protective jacket is formed. Please note that the term vulcanize, as used herein, does not necessarily indicate the use of sulfur to cure the elastomeric material.

The period of time required to fully cure a protective jacket about insulated conductors is determined by the combination of time: to first heat the entire elastomeric material to a cure temperature, and then, the length of time at which the elastomeric material must remain at that temperature to fully cure. Typically, the elastomeric material within the interstices between the insulated conductors is the last portion of the protective sleeve to be heated to the cure temperature, and consequently the last portion of elastomeric material to cure.

One method of curing the thermally set elastomeric material which provides the protective jacket is in a continuous cure process, such as a continuous vulcanization process. One typical prior art continuous vulcanization process included a vulcanization tube which was 91 meters (300 feet) long, of which about two-thirds of the length was filled with pressurized steam at a temperature of 204° C. (400 degrees Fahrenheit) and a pressure of 1.7 megapascals (250 pounds per square inch). The thermally set elastomeric material was extruded about the insulated conductors to form a protective jacket, and then passed through the vulcanization tube at a rate of speed of between 7.6 to 9.1 meters per minute (25 to 30 feet per minute). This rate of speed was selected to retain the elastomeric material within the steam filled portion of the tube for a long enough period of time to fully cure a protective jacket having an outer diameter of roughly 30 millimeters (one and three sixteenths inches). Of course, the rate of speed at which different sizes of cable can be cured by passing through the same length of vulcanization tube changes with the thickness and heat capacities of the materials to be cured.

A problem with continuous vulcanization processes arises in that the elastomeric material of a protective jacket must be retained within the tube for a period of time which is long enough to heat the entire protective jacket to a cure temperature, and then retained at this cure temperature for a sufficient length of time to fully cure the elastomeric material within the interstices of the insulated conductors. For a specific length of vulcanization tube, the dwell time at which the protective jacket is retained therein determines the speed at which the manufacturing process may be operated. If the dwell time at which the protective jacket is retained within the vulcanization tube could be decreased, in general, the manufacturing process could be operated at a faster rate, and thus improve productivity of the production process.

One way to improve the productivity of the manufacturing process is to batch cure the protective jacket by spooling the cable onto reels, and heating an entire length of cable within an oven. One such example is U.S. Pat. No. 4,675,474, issued on Jun. 23, 1987, and invented by David H. Neuroth, in which an elastomeric, protective jacket was cured after armoring and spooling the cable onto a reel. However, when a protective jacket is batch cured after spooling onto a reel, the insulated conductors therein may not be held in proper position, centered within the protective jacket, but rather may shift to one side. Shifting of insulated conductors within the protective jacket may reduce the wall thickness of elastomeric material about the conductors to a thickness which is insufficient for reliably providing a fluid barrier to prevent wellbore fluid from attacking the insulating material about the conductors.

Another problem with prior art electric cables arises since some electric cables are cured prior to helically wrapping an exterior armor about the protective jacket. Wrapping the exterior armor about a fully cured protective jacket results in applying internal compressive stresses to the jacket material.

Further, in prior art electric cables, the protective jacket is disposed inside of a metal, exterior armor. The elastomeric material forming the protective jacket typically has a higher coefficient of thermal expansion than metal from which the metal, exterior armor is formed. When prior art electric cables are heated to high temperatures found downhole within wellbores, the protective jacket will expand at a greater rate than the exterior armor. The greater rate of thermal expansion of the protective jacket within the armor creates compressive forces which act to apply potentially destructive stresses to the insulation about the electrical conductors.

Some prior art electric cables include longitudinally extending ribs about the exterior surface of the protective jacket. These longitudinally extending ribs provide expansion voids for the elastomeric material of the protective jacket to expand into when heated to wellbore temperatures, and thus aid in reducing thermally induced compressive stresses. When an exterior armor is helically wrapped about this exteriorly ribbed surface after the protective jacket is fully cured, the longitudinally extending ribs are flattened in a helically spiralled pattern. Flattening of ribs during the manufacturing process changes the location of thermal expansion voids, resulting in nonuniform compressive stresses when the electric cable is heated to downhole temperatures within a wellbore.

SUMMARY OF THE INVENTION

The above as well as additional objects, features, and advantages of the invention will become apparent in the following detailed description.

An electrical cable and a method for manufacturing the electrical cable are provided in which a plurality of insulated conductors have a protective jacket extruded thereabout. The protective jacket has an exterior ribbed surface which includes a plurality of longitudinally extending ribs between which extend a plurality of thermal expansion voids. The protective jacket is formed from a thermally set, elastomeric material which is only partially cured during a continuous vulcanization process. The ribs and a thin layer underneath the ribs are fully cured. The remaining portion, which includes the interstices between the insulated conductors, is not cured. This partial curing is performed by speeding up the continuous vulcanization process to a rate above that required to fully cure the protective jacket. The residence time in the hot portion of the vulcanization tube is thus reduced.

Then a protective exterior armor is helically wrapped around the exteriorly ribbed surface of the elastomeric, protective jacket. Compressive forces arising from helically wrapping the exterior armor about the protective jacket are uniformly distributed and dispersed through an interior portion of the elastomeric protective jacket since the interior portion of the elastomeric jacket has not been fully cured. The ribs do not completely flatten because of the central uncured portion of the protective jacket. Then, the electric cable is coiled onto a reel. The reel is subsequently placed in an oven and the electric cable is heated to an elevated temperature for a period of time which is sufficient for fully curing the elastomeric, protective jacket.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
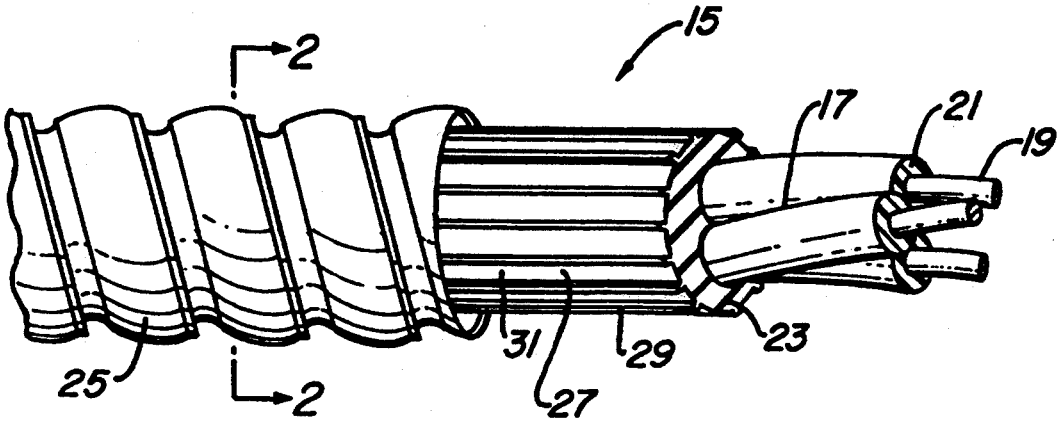
FIG. 1 is a fragmentary perspective view of an electrical cable for use in a wellbore to conduct electrical power to a downhole submersible pump.

With reference to FIG. 1, a fragmentary perspective view depicts electrical cable 15 for use in a wellbore to connect electrical power to a downhole submersible pump. Electrical cable 15 includes plurality of insulated conductors 17. In the preferred embodiment of the present invention, there are three insulated conductors 17. Each insulated conductor 17 includes an electrical conductor 19, and insulation 21 for preventing electrical current from passing between electrical conductors 19. Protective jacket 23 is formed about insulated conductors 17. Protective jacket 23 is provided to seal insulated conductors 17 to prevent wellbore fluids from deteriorating either insulation 21 or electrical conductors 19. A metal exterior armor 25 is helically wrapped about protective jacket 23 to protect protective jacket 23 against abrasion and to prevent crushing of insulated conductors 17 and protective jacket 23.

Typically, protective jacket 23 is a singular, continuous member formed of thermally set elastomeric material. In the preferred embodiment of the present invention, protective jacket 23 is formed from materials which are well known in the art, such as, for example, E.P.D.M. (Ethylene-Propylene-diene Monomers), or nitrile rubber. In the preferred embodiment of the present invention, electrical conductors 19 are solid copper conductors, and insulation 21 is formed from thermoplastic material which are well known in the art, such as, for example, E.P.D.M. (Ethylene-Propylene-diene Monomers), or polypropylene. Protective jacket 23 includes an exteriorly ribbed surface 27. Exteriorly ribbed surface 27 is formed by plurality of longitudinally extending ribs 29.

Figure 2:
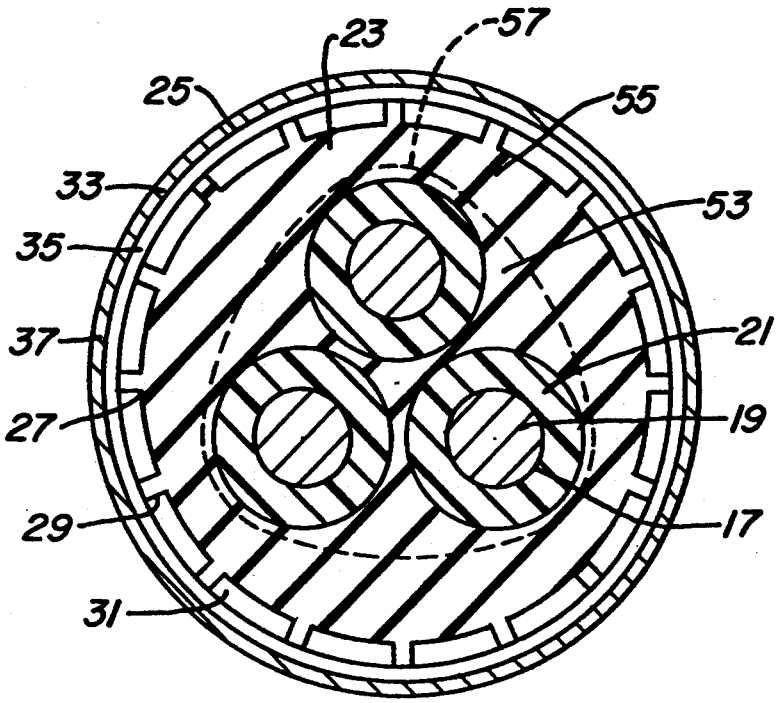
FIG. 2 is cross-sectional view of the electrical cable of FIG. 1, taken along section lines A—A.

Referring now to FIG. 2, a cross-sectional view depicts electrical cable 15, and is taken along section line A—A of FIG. 1. A plurality of thermal expansion voids 31 extend between longitudinally extending ribs 29. Thermal expansion voids 35 provided space for protective jacket 23 to expand into when electrical cable 15 is heated to downhole wellbore temperatures. It should be noted, that exterior armor 25 is typically formed of metallic material, and protective jacket 23 is typically formed of elastomeric material which thermally expands at a greater rate than metallic materials when heated to downhole wellbore temperatures. Thermal expansion voids 31 provide a place for protective jacket 23 to expand into as it is thermally expanded by a greater amount than exterior armor 25, and thus serve to reduce thermally induced compressive forces within protective jacket 23. The expansion voids 31 are uniformly spaced around the exterior of protective jacket 23.

Exterior armor 25 is applied about protective jacket 23 by helically wrapping a continuous strip 33 of exterior armor 25. Continuous strip 33 includes a flat underlying end 35 over which overlaying end 37 is lapped as exterior armor 25 is helically wrapped about protective jacket 23. Additionally, adhesive 39 secures plurality of insulated conductors 17 together, which are helically wrapped in a longitudinally extending direction.

Figure 3:
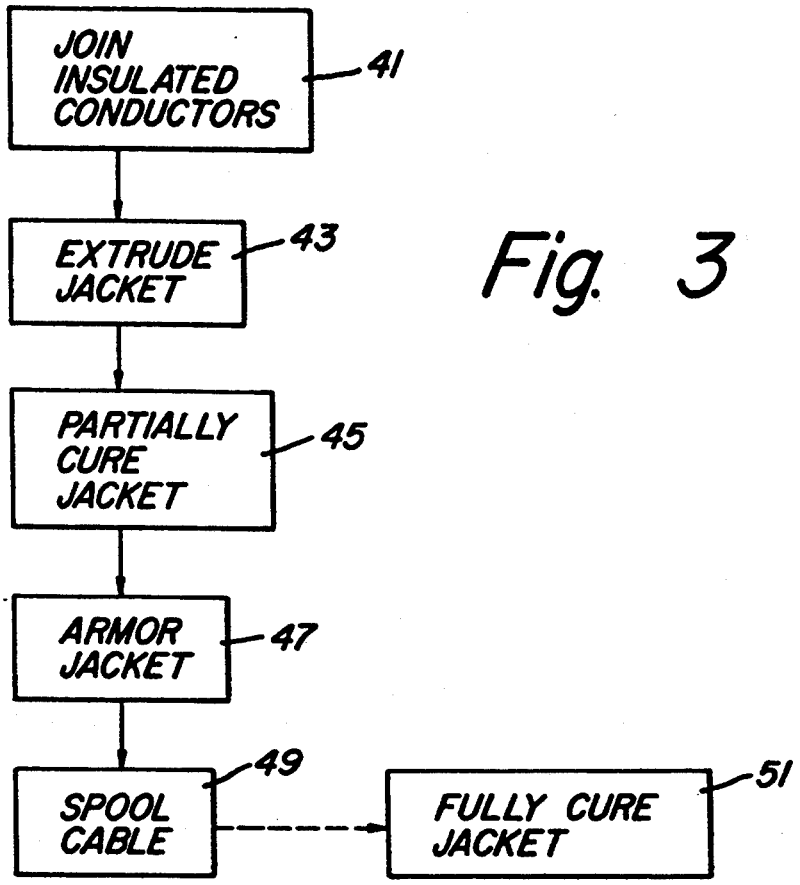
FIG. 3 is block diagram partially depicting the preferred method of manufacturing the electrical cable of the preferred embodiment of the present invention.

With reference to FIG. 3, a block diagram schematically depicts the preferred method of manufacturing the electric cable of the preferred embodiment of the present invention. Starting with block 41, insulated conductors 17 are joined by helically twisting the insulated conductors together. Then, as depicted by block 43, protective jacket 23 is extruded about the plurality of insulated conductors 17, by an extruding head which is well known in the prior art. Insulated conductors 17 and protective jacket 23 then pass through a continuous curing apparatus to partially cure protective jacket 23 as depicted by block 45.

The amount of time in the curing apparatus is controlled to fully cure longitudinally extending ribs 29 and a thin layer of elastomeric material underneath. In the preferred embodiment of the present invention, protective jacket 23 has an outside diameter of approximately 30 millimeters (one and three sixteenths inches), with longitudinally extending ribs approximately 0.794 millimeters (one thirty-seconds inches) long. The radial distance from the base of the ribs 29 to the exterior of the insulation 21 is about 1.270 millimeters (fifty thousandths (0.050) of an inch). The thin layer of elastomeric material underneath ribs 29 which is fully cured ranges in radial thickness from approximately 0.635 to 1.270 millimeters (twenty-five thousandths (0.025) to fifty thousandths (0.050) of an inch). Beneath this thin layer is a transition layer of partially cured elastomeric material, beneath which is a fully uncured layer of elastomeric material.

In the preferred embodiment of the present invention, the vulcanization tube used is the same as a prior art continuous vulcanization process described above is utilized for the continuous curing apparatus. The vulcanization tube is 91 meters (300 feet long), and about two-thirds of the length is filled with steam at a temperature of 204° C. (400 degrees Fahrenheit) and a pressure of 1.7 megapascals (250 pounds per square inch). However, the continuous vulcanization process of the preferred embodiment of the present invention is operated at a rate of approximately 23 to 30 meters per minute (75 to 100 feet per minute) to only partially cure protective jacket 23 as discussed above, rather than at the prior art rate of speed of between 7.6 to 9.1 meters per minute (25 to 30 feet per minute), which was for fully curing a prior art elastomeric, protective jacket. This allows the same manufacturing process line to operate a rate of 30 meters per minute (100 feet per minute), rather than the previous limit of 7.6 to 9.1 meters per minute (25 to 30 feet per minute), improving the productivity of the production process. At 23 to 30 meters per minute (75 to 100 feet per minute), and a steam section of 61 meters (200 feet), a point on the cable will be exposed to the high temperature for approximately two minutes to two minutes, forty-five seconds. In the prior art, the exposure to the high temperature is approximately two to four times more.

Exterior armor 25 is then helically wrapped about protective jacket 23 as depicted in block 47. Then, electric cable 15 is reeled onto a spool as depicted by block 49. It should be noted that the preferred method is a continuous process between blocks 41 and 49. Then, the spooled cable is placed in an oven and heated to a temperature between 121° C. and 149° C. (250 and 300 degrees Fahrenheit) for between 24 to 36 hours to fully cure protective jacket 23, as depicted by block 51. This last cure depicted by block 51 is a batch process, in which a plurality or spools of cable may be baked simultaneously to cure protective outer jacket 23.

Referring again to FIG. 2, protective jacket 23 includes an inner portion 53 and an outer portion 55 which are depicted as separated by dashed line 57. As illustrated in FIG. 2, protective jacket 23 is partially cured, as depicted in block 45 of FIG. 3, and provides support to retain plurality of insulated conductors 17 centered within protective jacket 23 during the manufacturing process steps of helically wrapping exterior armor 25 about protective jacket 23, spooling electrical cable 15 onto a reel, and placing electrical cable 15 within the last oven to completely cure protective jacket 23.

Still referring to FIG. 2, it should be noted that as armor 25 is wrapped about protective jacket 23, ribs 29 grippingly engage the interior surface of armor 25 to prevent slipping in a longitudinal direction along electrical cable 15. Armor 25 will then press against longitudinally extending ribs 29 causing compressive forces to arise within protective jacket 23. However, inner portion 53 of protective jacket 23 is not cured when exterior armor 25 is secured to protective jacket 23 in the preferred embodiment of the present invention, allowing these compressive forces to be dispersed uniformly within inner portion 53. Ribs 29 will flatten to some extent when wrapped with armor 25, but not completely. After fully cured, voids 31 will still remain. During thermal expansion within a well, protective jacket 23 will expand into voids 31.

Figure 4:
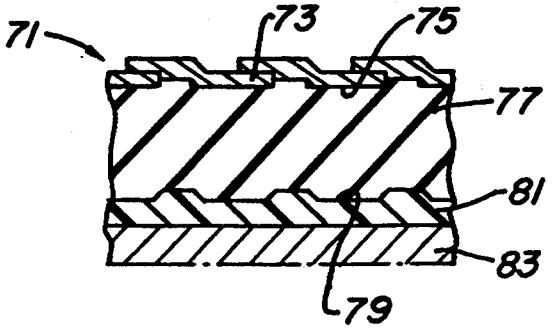
Fig. 4 (PRIOR ART)
FIG. 4 is fragmentary one-quarter longitudinal section view depicting a prior art electrical cable which is under compressive stresses induced by applying an exterior armor.

Referring now to FIG. 4, a fragmentary one-quarter longitudinal section view depicts a prior art electrical cable 71 which is under compressive stresses induced by applying an outer armor 73. When armor 73 is lapped, an outer indentation, or depression 75 is formed to helically extend into prior art protective jacket 77. Prior art protective jacket 77 then presses inner indentation 79 into insulation 81, causing a potential weakening of insulation 81 about conductor 83.

Figure 5:
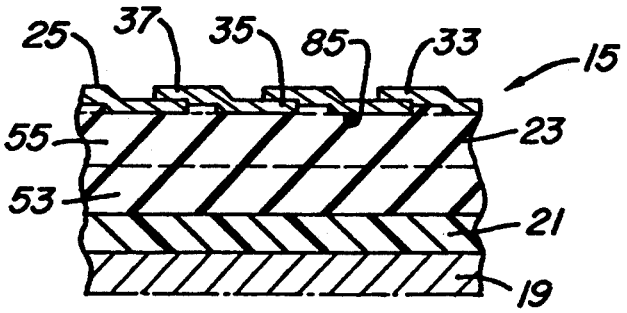
FIG. 5 is a fragmentary one-quarter longitudinal section view depicting the electrical cable of the preferred embodiment of the present invention after application of an exterior armor.

Referring now to FIG. 5, a fragmentary one-quarter longitudinal section view depicts electric cable 15 of the preferred embodiment of the present invention after application of exterior armor 25. As depicted in FIG. 5, where armor 25 is lapped by helically wrapping overlapping end 37 around underlapping end 35, an indentation 85 is formed into a protective jacket 23, which occurs in outer portion 55. However, inner portion 53 was not fully cured prior to securing armor 25 about protective jacket 23. In the uncured state, inner portion 53 was displaced by the compressive forces exerted to cause depression 85, and uniformly distributed within inner portion 53 so that there is not an indentation into insulation 21 of insulated conductor 17.

The present invention provides several advantages over prior art electrical cables and prior art methods for manufacturing electrical cables for use in wellbores to conduct electrical power to downhole submersible pumps. Since the protective jacket of the present invention is only partially cured during the continuous process for forming the cable, and then later batch cured to completely cure the elastomeric protective jacket, the manufacturing process line for producing the cable may be run faster. The electric cable is not required to be retained at a high temperature for curing the elastomeric protective jacket for the sustained period of time required for a full cure during the continuous cure process prior to armoring.

Another advantage of the present invention over the prior art is that compressive stresses induced within the electrical cable by securing the outer armor about the protective jacket are uniformly distributed about an inner portion of the protective jacket, reducing compressive stresses about the insulated conductors. Additionally, the insulated conductors remain centered with the protective jacket to provide a sufficient amount of protective jacket for protecting the insulation about the electrical conductors from attack by wellbore fluids. Further, thermal longitudinal expansion voids are spaced uniformly around the jacket. These voids provide a space for the elastomeric protective jacket to thermally expand into, reducing compressive forces within the elastomeric jacket which arise from the protective jacket expanding within the exterior armor at downhole well temperatures.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A method for manufacturing an electric cable for use in a wellbore to conduct electrical power to a downhole submersible pump, said method comprising, in the following order, the steps of:

providing a plurality of insulated conductors which provide, at least in part, a longitudinally extending central core;

extruding a protective jacket about said plurality of insulated conductors to encapsulate said plurality of insulated conductors therein;

curing in a continuous vulcanizing process only an exterior portion of said protective jacket by heating only said exterior portion to at least a cure temperature for a first time period of a limited duration to prevent an interior portion of said protective jacket from heating to said cure temperature for a sufficient interval of time to fully cure;

wrapping a metal armor exteriorly around said protective jacket to form said electric cable;

spooling said electric cable onto a reel; and placing said reel containing said electric cable into an oven for a time and temperature sufficient to fully cure said interior portion of said protective jacket.

2. The method of manufacturing an electric cable of claim 1, wherein said continuous vulcanizing process comprises:

feeding said protective jacket and insulated conductors into a vulcanizing tube which contains a pressurized steam at a temperature of substantially not less than 177° C. (350 degrees Fahrenheit; and passing said protective jacket and insulated conductors through said vulcanizing tube at a rate of speed which is not substantially less than thirty meters per minute (one hundred feet per minutes).

3. The method of manufacturing an electric cable of claim 1, wherein said temperature of said oven is not substantially less then 116° C. (240 degrees Fahrenheit) and said time within said oven is not substantially less than twenty-four hours.

4. The method of manufacturing an electric cable of claim 1, wherein said step of extruding said protective jacket about said sleeve includes providing an exteriorly ribbed surface having a plurality of ribs with a plurality of thermal expansion voids therebetween.

5. The method of manufacturing an electric cable of claim 1, wherein said step of extruding said protective jacket about said sleeve includes providing an exteriorly ribbed surface having a plurality of longitudinally extending ribs with a plurality of longitudinally extending thermal expansion voids therebetween.

6. A method for manufacturing an electric cable for use in a wellbore to conduct electrical power to a downhole submersible pump, said method comprising, in the following order, the steps of:

providing a plurality of insulated conductors which provide, at least in part, a longitudinally extending central core;

extruding a protective jacket about said plurality of insulated conductors to encapsulate said plurality of insulated conductors therein;

passing said protective jacket and said insulated conductors through a continuous vulcanizing tube to heat and fully cure only an exterior portion of said protective jacket and to not cure an interior portion of said protective jacket, said exterior portion which is fully cured having a radial thickness substantially in a range between 0.625 to 1.270 millimeters (twenty-five thousandths of an inch and fifty thousandths of an inch);

wrapping a metal armor exteriorly around said protective jacket to form said electric cable;

spooling said electric cable onto a reel; and placing said reel containing said electric cable into an oven for a time and temperature sufficient to fully cure said interior portion of said protective jacket.

7. The method of manufacturing an electric cable of claim 6, wherein said continuous vulcanizing process comprises:

feeding said protective jacket and insulated conductors into a vulcanizing tube which contains a pressurized steam at a temperature of substantially not less than 176° C. (350 degrees Fahrenheit); and passing said protective jacket and insulated conductors through said vulcanizing tube at a rate of speed which is selected to expose a point on the cable to the steam for approximately two minutes to two minutes, forty-five seconds.

8. The method of manufacturing an electric cable of claim 6, wherein said temperature of said oven is not substantially less then 116° C. (240 degrees Fahrenheit), and said time within said oven is not substantially less than twenty-four hours.

9. The method of manufacturing an electric cable of claim 6, wherein said step of extruding said protective jacket about said sleeve includes providing an exteriorly ribbed surface having a plurality of ribs with a plurality of thermal expansion voids therebetween.

10. The method of manufacturing an electric cable of claim 6, wherein said step of extruding said protective jacket about said sleeve includes providing an exteriorly ribbed surface having a plurality of longitudinally extending ribs with a plurality of longitudinally extending thermal expansion voids therebetween.

* * * * *